United States Patent [19]

Wolf

[11] 4,342,893

[45] Aug. 3, 1982

[54] COMPOSITE ELECTRICAL CONTACT AND BONDING MATERIAL

[75] Inventor: Heinrich Wolf, Hailer, Fed. Rep. of Germany

[73] Assignee: WC Heraeus GmbH, Hanau am Main, Fed. Rep. of Germany

[21] Appl. No.: 78,930

[22] Filed: Sep. 26, 1979

[30] Foreign Application Priority Data

Oct. 14, 1978 [DE] Fed. Rep. of Germany ..... 2844888

[51] Int. Cl.[3] ..... H01H 1/02

[52] U.S. Cl. ..... 200/268; 200/270; 428/582; 428/673; 428/929; 428/940; 228/247; 29/878; 29/879; 29/884

[58] Field of Search ..... 200/262–270, 200/275; 428/573, 574, 582, 583, 643, 645, 929, 673, 940; 228/56, 245, 246, 247; 29/854, 874–879, 882, 884

[56] References Cited

U.S. PATENT DOCUMENTS

| | | | |
|---|---|---|---|
| 1,801,171 | 4/1931 | Mueller et al. | 228/246 |
| 2,106,332 | 1/1938 | Wilkins | 200/267 |
| 2,181,083 | 11/1939 | Payette | 428/582 |
| 2,298,999 | 10/1942 | Allen . | |
| 2,347,172 | 4/1944 | Lox | 200/265 |
| 2,354,081 | 7/1944 | Weder | 29/879 |
| 2,414,463 | 1/1947 | Gunn et al. | 200/268 |
| 2,568,242 | 9/1951 | Matteson, Jr. | 200/268 |
| 2,641,670 | 6/1953 | Graves, Jr. | 200/265 |
| 3,113,196 | 12/1963 | Spooner et al. | 200/267 |
| 3,324,230 | 6/1967 | Sherlock | 228/56 |
| 3,346,350 | 10/1967 | Spooner | 428/929 |
| 3,459,516 | 8/1969 | Ty et al. | 428/929 |
| 3,750,252 | 8/1973 | Landman | 428/929 |
| 4,125,936 | 11/1978 | Rozmus | 29/879 |

FOREIGN PATENT DOCUMENTS

| | | | |
|---|---|---|---|
| 2601765 | 7/1976 | Fed. Rep. of Germany | 428/643 |
| 571228 | 8/1945 | United Kingdom . | |
| 998580 | 2/1965 | United Kingdom . | |
| 1111478 | 4/1968 | United Kingdom . | |
| 1234821 | 6/1971 | United Kingdom . | |

OTHER PUBLICATIONS

G. Rau—Catalog, p. 108, 1965.

*Primary Examiner*—William Price
*Assistant Examiner*—Gary E. Elkins
*Attorney, Agent, or Firm*—Frishauf, Holtz, Goodman & Woodward

[57] ABSTRACT

To permit direct bonding of a composite electric contact-and-bonding material to a carrier, such as a reed, magnetic strip, or the like, by thermo-electric heating, the side of the contact-and-bonding material is formed with projections, preferably projecting ridges, ribs, or beads, and a bonding or solder material in wire form is adhered, by rolling on to the valley between the projecting ridges, the bonding or soldering material leaving space free between adjacent ridges or ribs and not filling the entire recess, but projecting outwardly at least as far as the projections or ridges, and preferably slightly therebeyond. The soldering or bonding wire may have round or polygonal, preferably triangular cross section with a pointed tip extending outwardly to provide for concentration of heat upon resistance heating the contact material against the carrier strip.

11 Claims, 7 Drawing Figures

COMPOSITE ELECTRICAL CONTACT AND BONDING MATERIAL

Figure 1A:
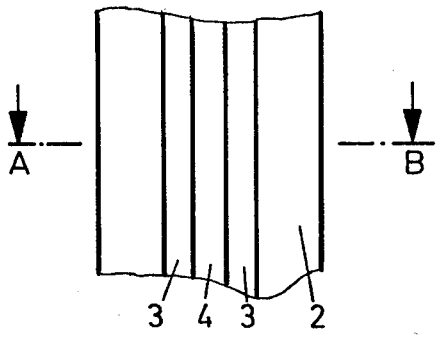

The present invention relates to electrical contacts, and more particularly to a composite electrical contact and bonding material which is provided in strip form and, when cut, can be bonded to a carrier, such as a spring reed, a magnetically, thermally, or otherwise responsive resilient strip, or the like.

BACKGROUND AND PRIOR ART

It is well known to apply electrical contact materials to carriers. Difficulty arises, however, in associating the material which forms the contact with the carrier itself. Heat-based bonding methods, such as soldering, brazing, or welding, are frequently difficult to apply, and the adhesion of the electrical contact to the carrier material itself often is not as permanent and as intimate as desired.

Various types of contact and bonding materials, which are eminently suitable for the contact introduce the aforementioned difficulties. One such contact material is described in British Pat. 1,111,478 (to which U.S. Pat. No. 3,016,350, Spooner, corresponds), intended for welding to a base carrier. During the welding process, however, it is possible to damage the surface of the contact material or, if the welding is carried out at lower temperature, the adhesion and reliability of the bonding contact is impaired. The difficulties are particularly glaring if the materials of the contact have high thermal conductivity, such as silver, copper, or alloys thereof. The electrical conductivity of these materials likewise interferes with proper bonding. Other materials which have been used cannot be, practically, welded at all by resistance welding methods, such as, for example, contact materials made of silver and metal oxide composites.

THE INVENTION

It is an object to provide a contact-and-bonding material from which electrical contacts can readily be made by associating the contact material with a carrier which can be joined to the carrier by resistance heating, and bonded to the carrier by welding, brazing, or soldering, and in which the resistance between the contact material and the carrier is high during the bonding process while, at the same time, providing for controllable defined current transfer, and hence heat generation during the bonding step.

Briefly, the contact material is provided in strip or tape form. It may have any desired and suitable composition. At the side where the contact material is to be bonded to the carrier, it is formed with at least two projections which, therebetween, define a valley or depression. In one particularly suitable form, the projections are formed as elongated ridges or ribs extending parallel to the longitudinal direction of the strip or tape. A solder or bonding wire is located in the valley or recess between the projection without, however, entirely filling the recess. The height of the bonding wire is at least as high as the adjacent projections and, preferably, may extend slightly therebeyond. The shape of the bonding wire can be as desired—round or, in accordance with a preferred embodiment, polygonal, with a corner of the polygon forming a point facing the carrier strip when the contact material and the carrier strip are to be joined. A suitable form is, for example, a triangle with a sharp point directed towards the carrier.

DRAWINGS

Figure 1B:
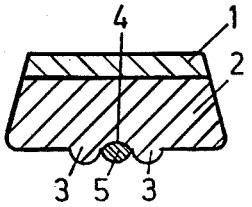
Figure 2:
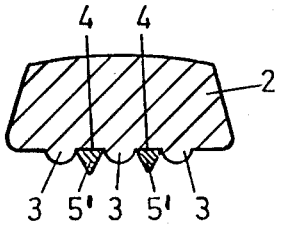
Figure 3A:
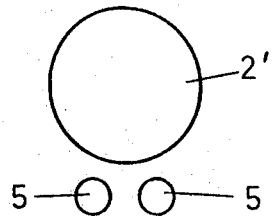
Figure 3B:
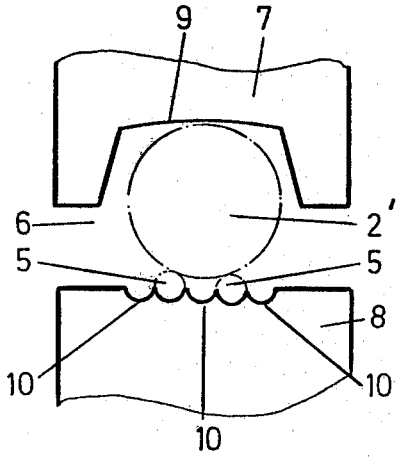
Figure 3C:
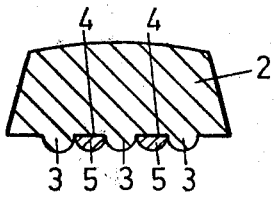
Figure 4:
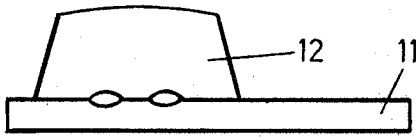

FIG. 1*a* is a bottom view of a contact-and-bonding strip;

FIG. 1*b* is a cross section through the strip of FIG. 1*a* along lines A–B;

FIG. 2 is a cross-sectional view similar to FIG. 1*b*, but illustrating another embodiment;

FIG. 3*a* shows the starting material for the contact-and-bonding strip used in the manufacture thereof;

FIG. 3*b* shows, highly schematically, the rolling and manufacturing step to form the strip;

FIG. 3*c* shows the finished strip made by the apparatus of FIG. 3*b*, starting with the base materials of FIG. 3*a*; and FIG. 4 shows a finished contact in which the contact-and-bonding material has been joined to a carrier, in side view.

The overall aim of the present invention is to form a contact as best shown in FIG. 4. The contact is a composite in which the contact element 12 is secured to a base or carrier 11 by welding, soldering, or brazing under resistance heating. The carrier material 11 may be copper, a copper alloy, a bronze, copper-beryllium alloys, a ferrous metal and alloys thereof, nickel silver, and especially magnetic carrier materials.

The contact-and-bonding material is prepared in strip or tape form—see FIG. 1*a*—and has a contacting surface which is adapted to make the electrical contact with an opposite contacting element. The contacting surface may be a precious metal or a precious metal alloy, such as silver or a silver alloy. The contact surface layer 1 (FIG. 1*b*) is applied to the contact-and-bonding material 2. The material 2 may be less precious, and have good electrical current carrying characteristics, such as a copper or copper alloy. It is also possible to make the entire contact only of the material 2, and to omit the precious metal coating 1. The obverse side, that is, the side of the material 2 which faces the carrier 11 (FIG. 4), is formed with projections in the shape of elongated ridges or ribs 3, extending parallel to the longitudinal direction of the tape or strip. As clearly seen in FIG. 1*a*, the ribs or ridges are parallel with respect to each other and placed symmetrically with respect to the longitudinal axis of the tape or strip. More than two parallel strips can be used, as shown, for example, in FIGS. 2 and 3*c*. The ridges or projections or strips 3 define therebetween a recess or valley 4. It is not necessary that the projections are continuous ridges or strips; rather, they may be formed as projecting bumps or the like, preferably uniformly and regularly distributed about the surface facing the carrier 11, when assembled therewith; the projections may also be formed as a knurl or a pin-projection pattern. The recesses, depressions or valleys which will be defined between the projections 3 retain a solder or brazing wire 5 which is secured to the bottom of the recess or valley 4. It is attached thereto, for example, by rolling. The outermost dimension of the wire 5 from the bottom of the valley is at least as high as the height of the projections 3, and preferably slightly higher. This ensures a predetermined defined current transition at the projections which will occur during resistance heating upon bonding of the material 2 to the carrier 11. The bonding can be carried out in electrical resistance welding machines in which the material 2 and the material 11 are clamped between electrodes; soldering processes may also be used. The wire 5, as clearly seen in FIGS. 1*b*, 2, 3*c*, does not fill the entire space between the projections 3 so that, even if, and as seen in FIG. 2, the wire 5 is not circular, but rather polygonal, and preferably triangular as shown, the tip or corner of the polygonal wire has a greater distance to the bottom of the recess or valley between the ridges or ribs than the height of the ridges or ribs themselves.

Upon resistance heating, heat will concentrate at the point of initial contact and this heat concentration will lead to rapid melting of the solder or bonding material of the wire 5. The projections 3, particularly when in ridge, rib, or bead form, have the additional advantage that the melted solder 5 is prevented from scattering or spraying upon bonding to the carrier 11 and, additionally, the ridges or ribs or beads 3 form protection against ingress of air and the oxygen therein during bonding of the contact material 2 to the carrier 11.

As seen in FIG. 2, a plurality of solder wires 5 are located between a multiplicity of ridges 3, the wires 5 being triangular. The contact body 2 is not coated with additional contact material 1 but, rather, is left free and is made of a material which is essentially uniform contact material, such as a silver alloy, silver, or a composite silver metal alloy, such as, and preferably, AgCdO. The actual structure of the contact material 2 or 12 itself does not form a part of the present invention and the material and shape thereof may be selected as desired. In a preferred form, however, and as shown in FIGS. 2 and 4, the outer surface of the contact is slightly bowed or bulged outwardly; the shape may, also, be essentially rhomboidal in cross section, as seen in FIG. 1*b*. In most cases it is desirable that the composite electrical contact-and-bonding material has a shape which at least approximately matches that of the final shape of the contact 12 which is desired. Of course, it is equally possible to apply additional contacting material over the contact material 2 of FIGS. 2, 3*c* by a suitable process, for example by galvanic deposition, vacuum deposition, or otherwise, for example chemically.

The solder wire 5 preferably is a silver solder, and most desirably is a silver alloy solder such as a silver-copper alloy with 28%—by weight—of copper and the remainder silver.

Contrary to prior art technology, it is not necessary to apply an intermediate layer to the contact-and-bonding material to insure a bond between the contact 12 and carrier 11. In accordance with the present invention, direct heat transmission from the contact 12 to the carrier 11 is insured since the contact material 12 is directly connected to the carrier n—see FIG. 4—except at the welding or soldering points or lines. These weld or solder points have a contacting area small with respect to the remaining connection area (see FIG. 4). The overall height of carrier 11 and contact 12 can be reduced, and the adhesion of the connection between contact 12 and carrier 11 is excellent and in no case less than in processes using intermediate fluxes and other materials.

The contact-and-bonding material, preferably, is made this way: An initially round wire of the material 2', and two wires of the material 5', are stored on supply reels and separately guided as seen in FIG. 3*a*, where the material 2 is in wire form 2'. The wire 2', upon being drawn from the supply reel, is first cleaned and then heated in a furnace in a protected atmosphere. The wires 5' need not be pre-heated, in contrast to the wire 2'. Wire 2' and the wires 5' are then introduced in a nip 6 between two profile rollers 7, 8 (FIG. 3*b*) which have matching profiles that are so selected that the wire 2' is shaped in the form which is finally desired (see FIG. 3*c*). The rollers 7, 8 squeeze the wire 2' in accordance with the inner configuration 9 of the roller 7 at the top side and in accordance with the grooves 10 of the roller 8 at the bottom. The solder wires 5 are guided in two grooves 10 of the bottom roller 8 and, as the wire passes through the narrow nip of the rollers 7, 8, the projections 3 are formed directly in the wire 2' while, simultaneously, the wires 5 are pressed into the grooves 4 and secured to the bottoms thereof. Thus, in a single working step, the finished material 2 of FIG. 3*c* is obtained. The two starting materials 2' and the wires 5' have their cross-sectional area reduced by at least 20%. The thus made strip or tape can be used directly for welding, brazing, or soldering on a carrier 11 and, after cutting, the finished contact 11, 12 (FIG. 4) can be made.

Other methods of making the composite contact-and-bonding material are possible; for example, it is not necessary to use a single roller step. Rather, sequential rolling steps can be used, for example with selected interposition of annealing or intermediate heating to incandescence, depending on the particular starting materials, or the combination of materials when composite contacts 12 are desired. The ridges between the grooves 10 of the roller 8 need not be uniform throughout the circumference of the roller 8 but, rather, can form bumps or projections between which the wires 5 are positioned.

Various changes and modifications may be made within the scope of the inventive concept.

In one typical example, the carrier 11 was a strip 40 mm wide, endless in length, 0.3 mm thick, of german silver, a copper base alloy of 18 percent nickel by weight, 20 percent tin, the remainder being copper.

Initially used for part 2' is a wire of between 1,5 and 3 mm diameter, for part 5' a wire of 0.25 mm diameter (starting materials, see FIG. 3*a*).

After attaching the wires 5' to part 2' before rolling (see FIG. 3*b*) and after rolling (see FIG. 3*c*) thereafter the projecting ridges 3 have a height of 0.05 mm. The wires 5 in the valleys between the ridges have the same height or are higher than the ridges 3.

After bonding (e.g. welding) as shown in FIG. 4 the height of the finished contact is approximately 0.5 mm and the overall height is 0.8 mm.

I claim:

1. Composite electrical contact-and-bonding material for bonding to a metallic carrier (11) comprising an elongated strip of contact material having a first contacting surface and an obverse bonding surface for bonding to said carrier, in which said bonding surface is formed with at least two projections (3) which define a recess (4) therebetween, and wherein, in accordance with the invention, the projections comprise at least two parallel elongated ridges or elongated ribs or elongated beads (3) defining a valley (4) between adjacent ridges, ribs or beads, said valley forming the recess;

and wherein a bonding wire (5, 5') is provided, positioned in the valley between the ridges, ribs or beads, said wire forming a bonding material, being secured to the bottom of the valley, only partly filling said valley, and having a dimension extending therefrom which is at least as high as the ridges or ribs or beads adjacent the valley.

2. Material according to claim 1, wherein more than two ridges or ribs or beads are provided, and a wire is located in each of the valleys between adjacent ridges or ribs or beads.

3. Material according to claim 1, wherein the contact material comprises a unitary, uniform contact material.

4. Material according to claim 1, wherein the contact material is a composite contact material.

5. Material according to claim 1, wherein the wire comprises silver or a silver alloy.

6. Material according to claim 1, wherein the wire (5) is adhered to the recesses between the projections by rolling-adhesion contact.

7. Material according to claim 1, wherein the wire (5) has an essentially circular cross section.

8. Material according to claim 1, wherein the wire (5') has a polygonal cross section.

9. Material according to claim 1, wherein the wire has a triangular cross section, and a corner or tip of the triangular extends slightly beyond the height of the projecting ridges or ribs or beads adjacent the valley.

10. Material according to claim 1, wherein said contact material (2) is compressed by rolling compression.

11. Material according to claim 1, wherein the wire extends slightly beyond the height of the projecting ridges or ribs or beads adjacent the valley.

* * * * *